US006938978B2

(12) United States Patent
Kosugi et al.

(10) Patent No.: US 6,938,978 B2
(45) Date of Patent: Sep. 6, 2005

(54) CONTAINER FOR PRINTING FLUID MATERIAL

(75) Inventors: Yasuhiko Kosugi, Nagano-ken (JP); Noboru Asauchi, Nagano-ken (JP); Takakazu Fukano, Nagano-ken (JP); Toshihisa Saruta, Nagano-ken (JP); Eiichi Ishii, Kitakyusyu (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 10/642,884

(22) Filed: Aug. 18, 2003

(65) Prior Publication Data

US 2004/0113965 A1 Jun. 17, 2004

(30) Foreign Application Priority Data

Aug. 22, 2002 (JP) ..... 2002-241450
Apr. 14, 2003 (JP) ..... 2003-108567

(51) Int. Cl.[7] ..... B41J 29/393
(52) U.S. Cl. ..... 347/19; 347/50; 399/27
(58) Field of Search ..... 347/19, 50; 399/12, 399/13, 27

(56) References Cited

U.S. PATENT DOCUMENTS 3,713,148 A * 1/1973 Cardullo et al. ..... 342/42
6,385,407 B1 5/2002 Inose
6,665,501 B2 * 12/2003 Okada et al. ..... 399/27
2004/0155913 A1 * 8/2004 Kosugi et al. ..... 347/6

FOREIGN PATENT DOCUMENTS

| | | |
|---|---|---|
| EP | 1 153 752 A | 11/2001 |
| EP | 1 164 022 A | 12/2001 |
| JP | 2001-147146 | 5/2001 |
| WO | WO-02/061578 A2 | 8/2002 |

OTHER PUBLICATIONS

Search Report in European Patent Appln. No. 0 32 55 103.8.

* cited by examiner

*Primary Examiner*—Lamson Nguyen
*Assistant Examiner*—Blaise Mouttet
(74) *Attorney, Agent, or Firm*—Stroock & Stroock & Lavan LLP

(57) ABSTRACT

The present invention is a container for holding printing fluid material. The container includes a detector, a memory unit, a communication module, a first electric power generator, and a second electric power generator. The communication module is configured to transmit at least one of a result of the detection and the information regarding the container to the printing device. The first electric power generator is configured to generate a first electric power by utilizing the radio wave received from the printing device. The second electric power generator is configured to generate a second electric power from the first electric power. The second electric power is supplied to both the detector and the memory unit.

14 Claims, 7 Drawing Sheets

CONTAINER FOR PRINTING FLUID MATERIAL

BACKGROUND OF THE INVENTION

1. Field of the Invention

The present invention relates to a container for holding a printing fluid material, which is capable of communicating with a printing device via radio waves.

2. Description of the Related Art

Some of ink cartridges attached to a printing device, such as an ink jet printer, have a memory that stores cartridge-related information including the production number, the production date, and the unsealed date of the ink cartridge and ink-related information including the type and the residual quantity of ink held in the ink cartridge. Some of these ink cartridges also have a sensor that detects the status of ink, for example, the residual quantity or the temperature of ink. One proposed technique directly measures the status of ink by taking advantage of a piezoelectric element, as disclosed in, for example, Patent Laid-Open Gazette No. 2001-147146. The prior art ink cartridge transmits various pieces of information to and from the printing device via communication, so as to manage the cartridge-related information and the ink-related information.

Communication of the ink cartridge with the printing device is typically established by electrical connection between them. This prior art ink cartridge may, however, have difficulties in stable communication, due to a loose connection of a connection terminal. A recently proposed technique for stable communication utilizes radio waves to establish wireless communication of the ink cartridge with the printing device. This technique does not allow the ink cartridge to directly receive a supply of electric power from the printing device via wire. Operating circuits in the ink cartridge are thus driven, for example, by means of an electromotive force induced by the radio waves received from the printing device.

The ink cartridge is an expendable and the simplified circuit configuration is naturally desirable. This issue is not restrictive in the ink cartridges for holding inks therein but is of great importance in containers for various printing fluid materials or flowable materials, for example, in toner cartridges for holding toners therein.

SUMMARY OF THE INVENTION

The object of the present invention is thus to simplify the circuit configuration of a container for holding a printing fluid material therein, which establishes wireless communication with a printing device.

In order to attain at least part of the above and the other related objects, the present invention is directed to a first container for holding printing fluid material. The container is configured to be attached to a printing device and communicating with the printing device via a radio wave. The container comprises a detector, a memory unit, a communication module, a first electric power generator, and a second electric power generator. The detector is configured to detect a status of the printing fluid material held in the container. The memory unit is configured to store information regarding the container. The communication module is configured to transmit at least one of a result of the detection and the information regarding the container to the printing device. The first electric power generator is configured to generate a first electric power by utilizing the radio wave received from the printing device. The second electric power is generator configured to generate a second electric power from the first electric power. The second electric power is supplied to both the detector and the memory unit.

The 'status of the printing fluid material' is, for example, the residual quantity, the temperature, or the viscosity of the printing fluid material. The 'information regarding the container' is, for example, the production number, the production date, or the unsealed date of the container or the type or the residual quantity of the printing fluid material held in the container. The container may be freely detachable from and attachable to the printing device or may be fixed to the printing device in an undetachable manner. The container may allow or prohibit refill of the printing fluid material.

In the first container of the invention, the second electric power is generated from the fist electric power, which is generated by utilizing the radio wave received from the printing device, and is supplied to both the detector and the memory unit. This arrangement does not require separate power supply systems for supplying electric powers to both the detector and the memory unit, thus desirably simplifying the circuit configuration of the container.

In one preferable configuration of the first container of the invention, the second electric power generator comprises a boosting circuit configured to boost the first electric power.

This arrangement enables the detector and the memory unit to be operated at a higher operating voltage than the voltage of the first electric power.

In this preferable configuration, the boosting circuit is, for example, a charge pump. Any of diverse DC/DC converters, such as a switching regulator, may be used in place of the charge pump.

In the first container of the invention, the detector may include a sensor of a piezoelectric element.

The sensor of the piezoelectric element generally requires a higher operating voltage than the voltage of the first electric power generated by the first electric power generator. In the preferable configuration of the invention, the second electric power generator has the boosting circuit, so as to ensure a supply of a high voltage to the sensor.

In another preferable configuration of the first container of the invention, the memory unit is a rewritable non-volatile memory that requires a higher voltage for rewriting and erasing of stored data than a voltage required for reading the stored data.

For example, a non-volatile memory like an EEPROM requires a higher voltage for writing or erasing data than a higher voltage for reading. In the preferable configuration of the invention, the second electric power generator has the boosting circuit, so as to ensure a supply of the high voltage power to the non-volatile memory.

In one preferable embodiment of the invention, the first container further includes a voltage drop module configured to drop a voltage of the electric power supplied from the second electric power generator to at least one of the detector and the memory unit.

For example, it is assumed that the memory unit (for example, the EEPROM) requires a relatively high voltage, while the detector requires a relatively low voltage. In this case, the second electric power generator is constructed to output the voltage required by the memory unit. The detector receives a supply of the electric power having the dropped voltage by the voltage drop module. The voltage drop module enables different electric powers to be supplied from one common voltage generator to multiple circuits that require different voltages of powers Here the voltage drop module may be a circuit including at least one diode connected in series between the second electric power generator and at least one of the detector and the memory unit. The voltage drop module may otherwise be a circuit including at least one diode connected in parallel with at least one of the detector and the memory unit.

The present invention is also directed to a second container for holding a printing fluid material. The second container is configured to be attached to a printing device and communicating with the printing device via a radio wave. The container comprises a first electric power generator, a plurality of operating circuits, and a boosting circuit. The first electric power generator is configured to generate a first electric power by utilizing the radio wave received from the printing device. The plurality of operating circuits are configured to operate at a higher operating voltage than a voltage of the first electric power. The boosting circuit is configured to boost the first electric power. The boosting circuit is shared by at least part of the plurality of operating circuits.

The container may be equipped with various operating circuits, such as the sensor and the memory discussed above, which require higher operating voltages than the voltage of the electric power generated by the first electric power generator. In a container or ink cartridge for holding multiple inks, each ink reservoir may have a separate sensor. In the second container of the invention, the boosting circuit is shared by the plurality of operating circuits requiring a substantially same operating voltage. This arrangement thus desirably simplifies the circuit configuration.

In the second container of the invention, the boosting circuit may be shared by the plurality of operating circuits having an equivalent operating voltage. The boosting circuit may also be shared by plural operating circuits having different operating timings.

In one preferable embodiment of the invention, the second container further comprises a voltage drop module configured to drop a voltage of the electric power supplied from the boosting circuit to the part of the plurality of operating circuits. The plurality of operating circuits receive electric power supplied from the boosting circuit.

Here the voltage drop module may be a circuit including at least one diode connected in series between the boosting circuit and the part of the multiple operating circuits that receive the supply of electric power from the boosting circuit. The voltage drop module may otherwise be a circuit including at least one diode connected in parallel with the part of the multiple operating circuits that receive the supply of electric power from the boosting circuit.

The technique of the present invention is not restricted to the containers discussed above. Other possible applications of the invention include a status measurement device like a residual quantity measurement device, a status measurement control method, a status measurement control device, corresponding computer programs for attaining these devices and method, recording media in which such computer programs are recorded, data signals that include such computer programs and are embodied in carrier waves, and a print head and a cartridge used for the printing device.

These and other objects, features, aspects, and advantages of the present invention will become more apparent from the following detailed description of the preferred embodiment with the accompanying drawings.

DESCRIPTION OF THE PREFERRED EMBODIMENTS

The present invention is explained in the following sequence based on the embodiment.

Figure 1:
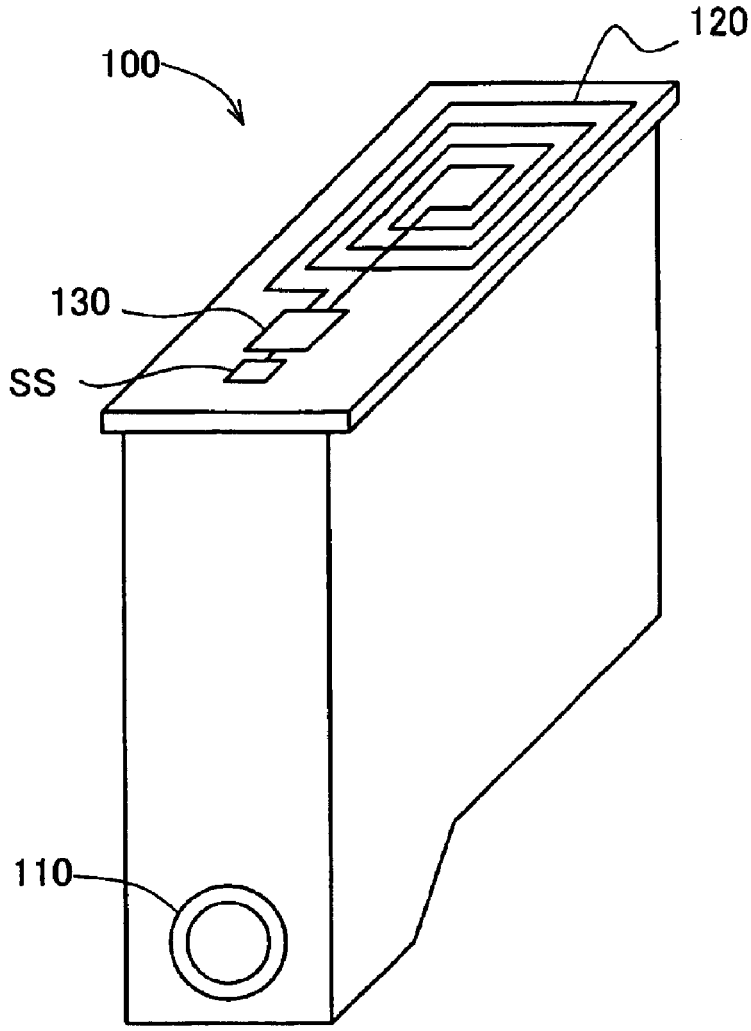
FIG. 1 is a perspective view illustrating the appearance of an ink cartridge in one embodiment of the invention.

A. General Configuration of Ink Cartridge
B. Electrical Configuration of Ink Cartridge
C. Circuit Configuration of Residual Ink Quantity Detector
D. Residual Ink Quantity Measurement Routine
E. Modifications A. General Configuration of Ink Cartridge FIG. 1 is a perspective view illustrating the appearance of an ink cartridge 100 in one embodiment of the invention. The ink cartridge 100 has an ink tank for holding one ink. An ink supply opening 110 is formed in the lower portion of the ink cartridge 100 to feed a supply of ink to a print head in a printer. The top face of the ink cartridge 100 has an antenna 120 for wireless communication with the printer, a sensor SS used to measure a residual quantity of ink, and a logic circuit 130.

In the configuration of this embodiment, a piezoelectric element is used for the sensor SS. The ink cartridge 100 applies a voltage onto the sensor SS to vibrate the piezoelectric element by the reverse piezoelectric effects and measures a vibration frequency of the piezoelectric element based on a variation in voltage due to the piezoelectric effects of the remaining vibration. The vibration frequency varies according to the quantity of ink remaining in the ink cartridge and is thus used as the criterion for detection of the residual quantity of ink. According to the experiments of the applicant, the frequency was equal to 90 KHz at a sufficient quantity of ink and was equal to 110 KHz at a substantial empty of ink. The frequency naturally varies with a variation in volume of the ink cartridge and is thus not unequivocally determined for all ink cartridges.

B. Electrical Configuration of Ink Cartridge

Figure 2:
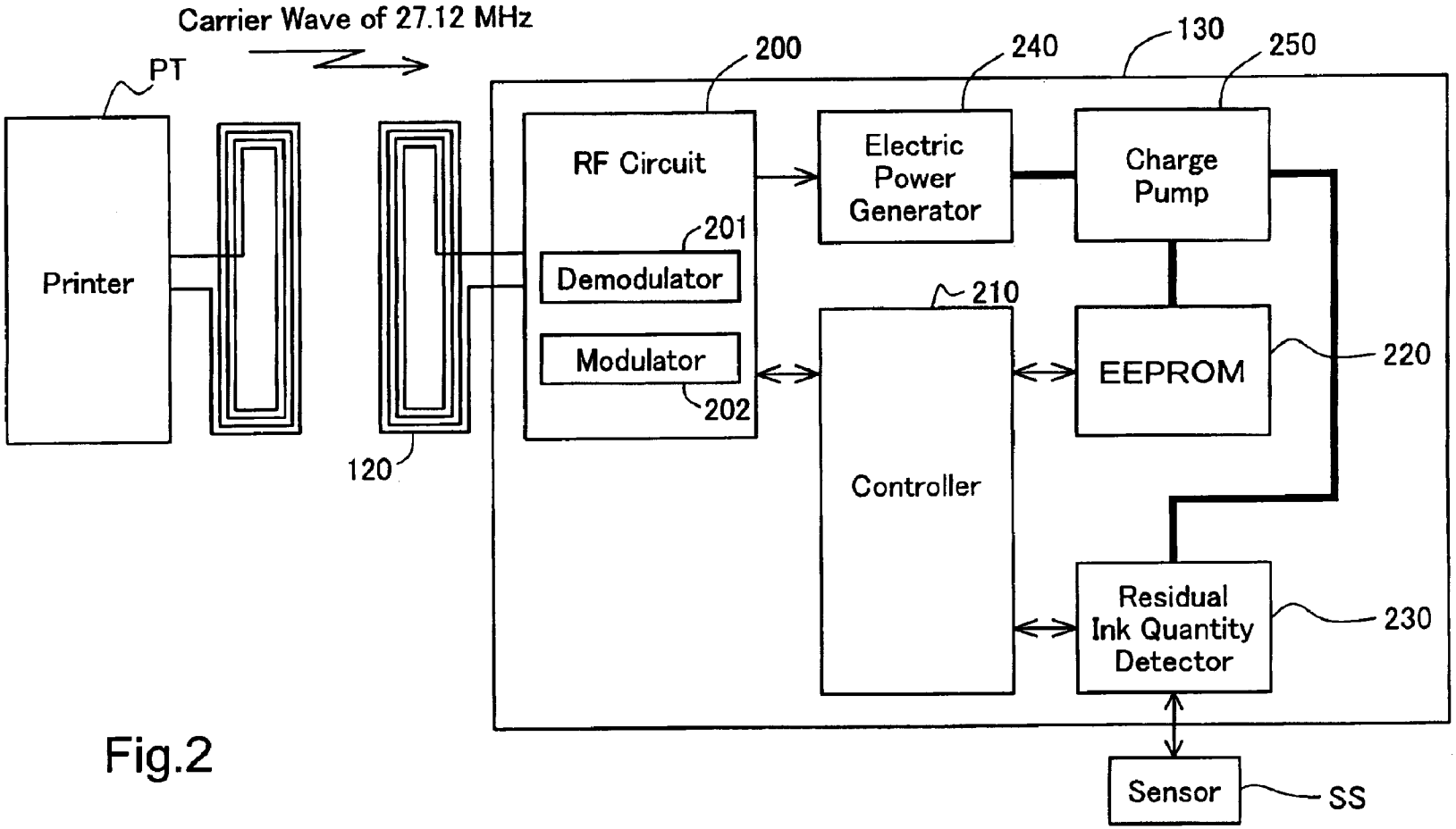
FIG. 2 is a block diagram showing the configuration of a logic circuit included in the ink cartridge of FIG. 1.

FIG. 2 is a block diagram showing the configuration of the logic circuit 130 included in the ink cartridge 100. The logic circuit 130 includes an RF circuit 200, a controller 210, an EEPROM 220, a residual ink quantity detector 230, an electric power generator 240, and a charge pump 250.

The RF circuit 200 includes a demodulator 201 that demodulates the radio wave received from a printer PT via the antenna 120, and a modulator 202 that modulates an input signal from the controller 210 and transmits the modulated signal to the printer PT. The printer PT generates a carrier wave of 27.12 MHz, makes the carrier wave subjected to ASK modulation, and transmits the ASK-modulated carrier wave as control signals to the ink cartridge 100. The ASK modulation varies the amplitude of the carrier wave in response to digital signals.

Commands and data to be sent back from the controller 210 to the printer PT, on the other hand, undergo PSK modulation by the modulator 202, prior to transmission. The PSK modulation varies the phase of the carrier wave in response to digital signals. The printer PT and the ink cartridge 100 communicate with each other in this manner. The modulation systems described here are only illustrative, and other modulation systems may be applicable according to the requirements.

The controller 210 carries out various control operations according to the control signals demodulated by the demodulator 201. The control operations include, for example, an operation of reading information recorded in the EEPROM 220 and transmitting the information to the printer PT and an operation of transmitting a signal for detection of the residual ink quantity to the residual ink quantity detector 230.

Various pieces of information, for example, on the production number and the production date of the ink cartridge 100 and the type of ink kept in the ink cartridge 100 have been recorded in advance in the EEPROM 220. The controller 210 reads these pieces of information from the EEPROM 220 and transmits the information to the printer PT, in response to a given instruction from the printer PT. Other pieces of information are also writable in the EEPROM 220; for example, data on the residual quantity of ink detected by a method discussed below and data on the unsealed date of the ink cartridge 100.

The electric power generator 240 rectifies the carrier wave received by the RF circuit 200 to generate an electric power of 5 V. The electric power generator 240 corresponds to the 'first electric power generator' in the claims. The electric power generator 240 is connected with the RF circuit 200, the controller 210, and the EEPROM 220 and is used as an electric power supply for operating these circuit elements, although connection lines are omitted from the illustration of FIG. 2 for clarity. As shown by a thick line in FIG. 2, the electric power generator 240 is also connected with the charge pump 250.

The EEPROM 220 and the residual ink quantity detector 230 are connected to the charge pump 250. A higher voltage than 5 V, which is generated by the electric power generator240, is required to allow the controller 210 to write data into the EEPROM 220 or to vibrate the piezoelectric element of the sensor SS. In the configuration of this embodiment, the EEPROM 220 and the piezoelectric element of the sensor SS are operated with an equivalent voltage at different timings. The charge pump 250 boosts the voltage generated by the electric power generator 240 and thereby generates a voltage required for allowing the controller 210 to write data into the EEPROM 220 and a voltage required for driving the sensor SS. This charge pump 250 corresponds to the 'second electric power generator' and the 'boosting circuit' in the claims. The charge pump 250 may be replaced with any of diverse boosting-type DC/DC converters, such as a switching regulator.

C. Circuit Configuration of Residual Ink Quantity Detector

Figure 3:
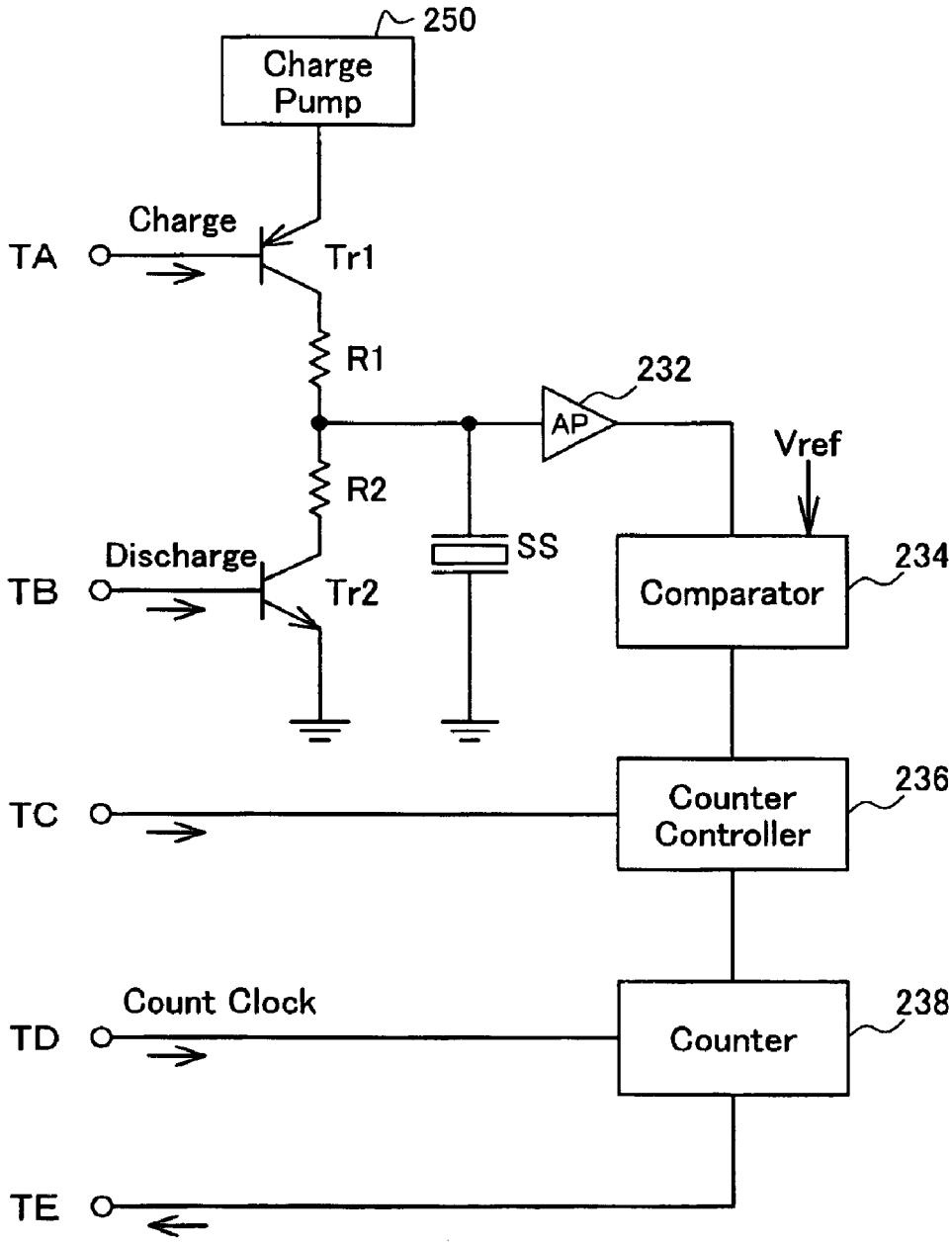
FIG. 3 is a circuit diagram showing the configuration of a residual ink quantity detector included in the logic circuit of FIG. 2.

FIG. 3 shows the circuit configuration of the residual ink quantity detector 230. The residual ink quantity detector 230 includes two transistors Tr1 and Tr2, two resistors R1 and R2, an amplifier 232, a comparator 234, a counter controller 236, a counter 238, and an oscillator (not shown). The residual ink quantity detector 230 also has a terminal TA for inputting a charge signal from the controller 210 into the transistor Tr1, a terminal TB for inputting a discharge signal into the transistor Tr2, a terminal TC for inputting a signal into the counter controller 236, a terminal TD for inputting a count clock from the oscillator into the counter 238, and a terminal TE for outputting a resulting count on the counter 238 to the controller 210.

The transistor Tr1 is a PNP transistor and has a base connecting with the terminal TA, an emitter connecting with the charge pump 250, and a collector connecting with the sensor SS via the resistor R1. The transistor Tr2 is, on the other hand, an NPN transistor and has a base connecting with the terminal TB, a collector connecting with the sensor SS via the resistor R2, and a grounded emitter.

One end of the sensor SS is grounded, while the other end of the sensor SS connects with the transistors Tr1 and Tr2 via the resistors R1 and R2 and is also linked with the amplifier 232. The amplifier 232 is further joined with the comparator 234. An output terminal of the comparator 234 is connected to the counter controller 236, and an output terminal of the counter controller 236 is connected to the counter 238. An output terminal of the counter 238 is connected to the terminal TE.

Figure 4:
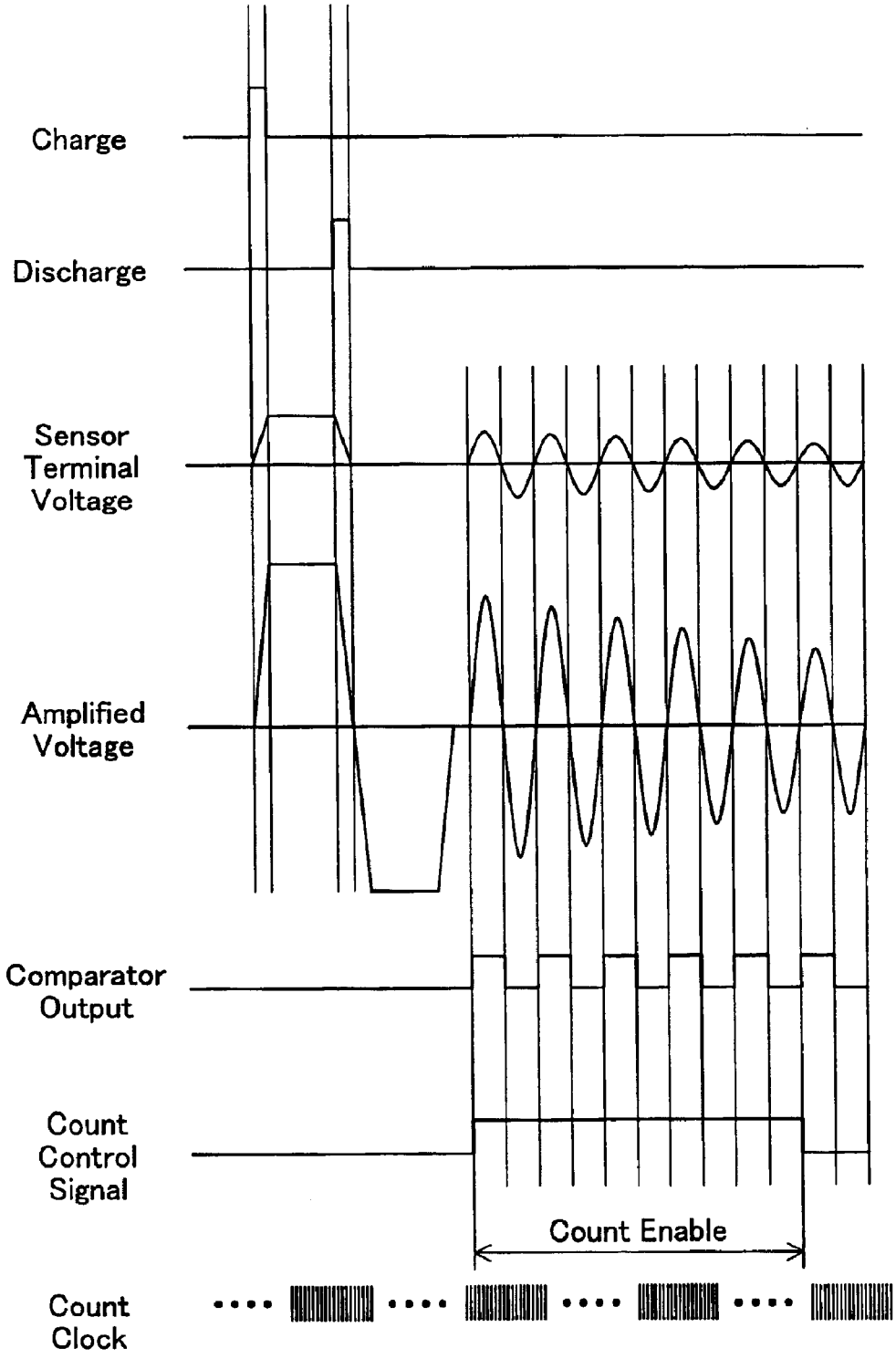
FIG. 4 is a timing chart in a circuit constituting the residual ink quantity detector.

The operations in this circuit configuration are discussed below with reference to the timing chart of FIG. 4. The transistor Tr1 is set ON at a rise of the charge signal from the controller 210 to a high level. The voltage generated by the charge pump 250 is accordingly applied onto the sensor SS via the resistor R1, so that the piezoelectric element of the sensor SS is distorted by the reverse piezoelectric effects. When the controller 210 drops the charge signal to a low level and raises the discharge signal to a high level, the transistor Tr2 is set ON to discharge the sensor SS via the resistor R2. The discharge of the sensor SS vibrates the piezoelectric element to cause a variation in voltage by the piezoelectric effects. The amplifier 232 amplifies this voltage variation. The comparator 234 compares the amplified voltage variation with a predetermined reference voltage Vref, specifies a result of the comparison as either a high-level signal or a low-level signal, and outputs the specified high-level or low-level signal to the counter controller 236. The counter controller 236 receives the input signal from the terminal TC and generates a counter control signal to validate the operation of the counter 238 for a time period corresponding to 5 pulses of the output signal from the comparator 234 since a start of the resonance vibration of the piezoelectric element. The counter 238 counts the number of pulses in the count clock input from the terminal TD, while the count control signal is at the high level (in the count enable state). The resulting count on the counter 238 is transmitted to the controller 210 and then to the printer PT. The printer PT calculates the vibration frequency of the sensor SS from the resulting count on the counter 238 and thereby determines the residual quantity of ink in the ink cartridge 100.

D. Residual Ink Quantity Measurement Routine

Figure 5:
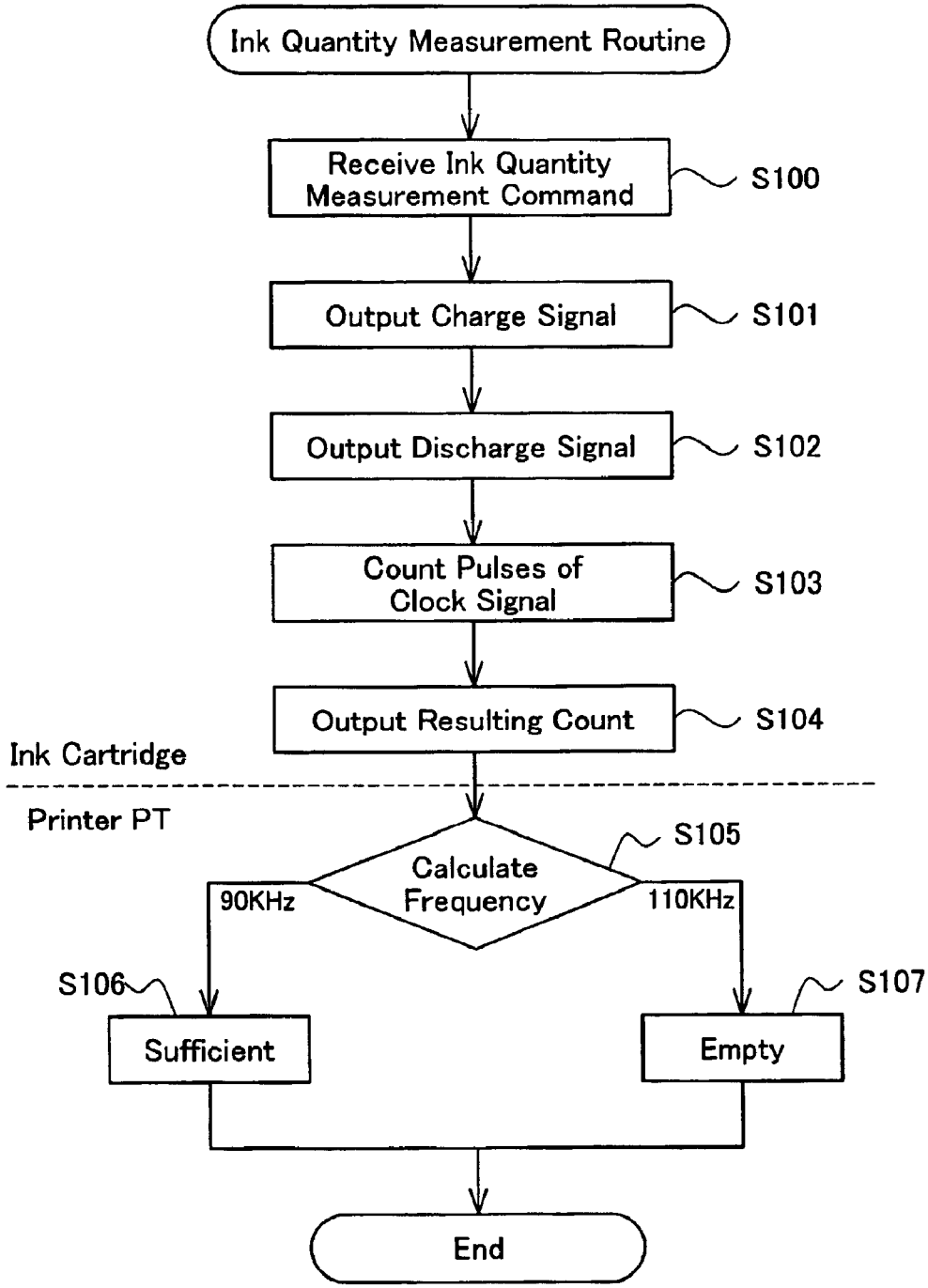
FIG. 5 is a flowchart showing a residual ink quantity measurement routine.

FIG. 5 is a flowchart showing a residual ink quantity measurement routine, which includes a series of processing executed by the ink cartridge 100 and a series of processing executed by the printer PT. The controller 210 of the ink cartridge 100 receives an ink quantity measurement command from the printer PT via the RF circuit 200 (step S100) and outputs the charge signal to the residual ink quantity detector 230 in response to the ink quantity measurement command (step S101). After elapse of a preset time period, the controller 210 outputs the discharge signal (step S102) and activates the counter 238 of the residual ink quantity detector 230 to count the number of pulses in the count clock (step S103). The controller 210 outputs the resulting count to the printer PT via the RF circuit 200 (step S104). In the printer PT, the oscillator included in the residual ink quantity detector 230 has a known oscillation frequency. The printer PT calculates the vibration frequency of the sensor SS from the resulting count and determines the ink remaining status of the ink cartridge 100 according to the calculated vibration frequency (step S105). The printer PT specifies a sufficient quantity of ink at the frequency of 90 KHz (step S106), while specifying a substantial empty of ink at the frequency of 110 KHz (step S107). This series of processing determines the residual quantity of ink in the ink cartridge 100.

In the ink cartridge 100 of this embodiment discussed above, the charge pump 250 generates the electric powers, which are supplied to both the EEPROM 220 and the sensor SS. This arrangement does not require separate power supply systems for supplying electric powers to the EEPROM 220 and the sensor SS and thus advantageously simplifies the circuit configuration.

E. Modifications

The embodiment discussed above is to be considered in all aspects as illustrative and not restrictive. There may be many modifications, changes, and alterations without departing from the scope or spirit of the main characteristics of the present invention. Some examples of possible modification are given below.

E-1. MODIFIED EXAMPLE 1

In the configuration of the embodiment, the ink cartridge 100 has the sensor SS for detecting the residual quantity of ink, as the detector in the claims which detects the status of ink. The sensor SS for detecting the residual quantity of ink is, however, not restrictive at all. The sensor SS may be replaced by another sensor, such as a temperature sensor or a viscosity sensor. The ink cartridge may include multiple sensors.

E-2. MODIFIED EXAMPLE 2

The above embodiment regards application of the present invention to the ink cartridge 100 that holds one ink. The technique of the present invention is also applicable to an ink cartridge that holds multiple inks therein. The ink cartridge holding multiple inks therein generally has multiple sensors SS. In the ink cartridge of the invention, the boosting circuit is shared by at least part of multiple operating circuits. In one modified configuration, one charge pump may be shared by the EEPROM and the multiple sensors. Another modified configuration has two charge pumps, one exclusively used for the EEPROM and the other shared by the multiple sensors.

E-3. MODIFIED EXAMPLE 3

The above embodiment regards application of the invention to the ink cartridge that holds the ink therein. The ink cartridge is, however, not restrictive at all, but the technique of the invention may be applicable to a toner cartridge that holds a toner therein or in general to a container for holding a printing fluid material.

E-4. MODIFIED EXAMPLE 4

The controller 210 is actualized by the hardware construction in the above embodiment, but may alternatively be attained by a software configuration. For example, the controller 210 may be replaced by a microcomputer including a CPU, a ROM, and a RAM. In the configuration of the embodiment, the residual ink quantity is determined by the series of processing executed by both the ink cartridge 100 and the printer PT. The residual ink quantity may, however, be determined by a series of processing executed by only the ink cartridge 100.

E-5. MODIFIED EXAMPLE 5

In the configuration of the embodiment, the logic circuit 130 (FIG. 2) is designed to apply an identical voltage to the EEPROM 220 and the residual ink quantity detector 230. Different voltages may, however, be applied to the EEPROM 220 and the residual ink quantity detector 230 as shown in modified examples of FIGS. 6 and 7.

Figure 6:
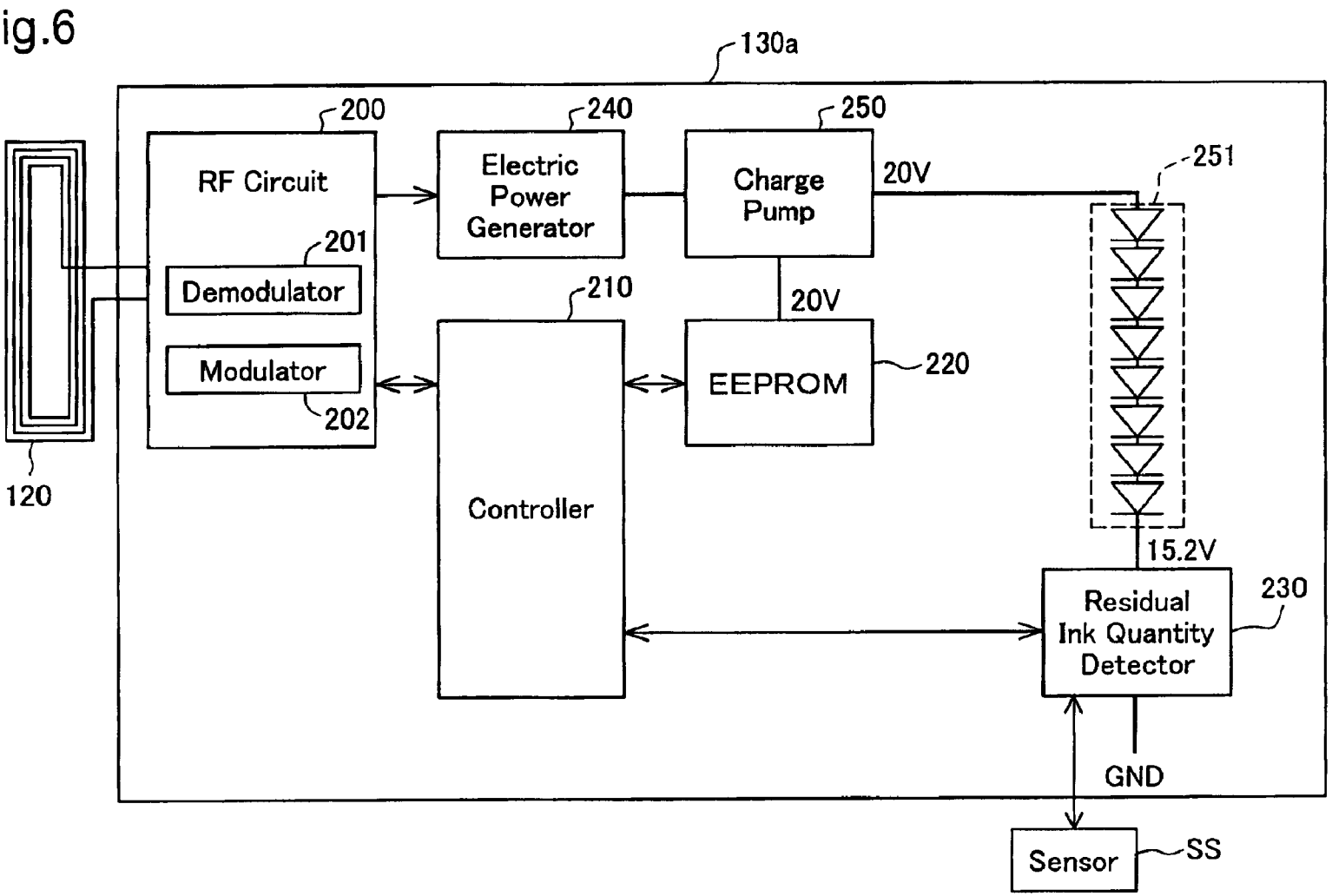
FIG. 6 is a block diagram showing the configuration of another logic circuit including a voltage drop circuit disposed between a second electric power generator and the residual ink quantity detector in one modified example.

FIG. 6 shows the configuration of a logic circuit 130*a*, which includes a voltage drop circuit 251 disposed between the charge pump 250 and the residual ink quantity detector 230. In the logic circuit 130*a* of this modified example, the charge pump 250 directly supplies an electric power of a voltage 20 V to the EEPROM 220, while supplying an electric power of a voltage 15.2 V via the voltage drop circuit 251 to the residual ink quantity detector 230.

The voltage drop circuit 251 has 8 diodes connected in series and is designed by taking advantage of the stable forward voltages of the diodes at 0.6 V.

Figure 7:
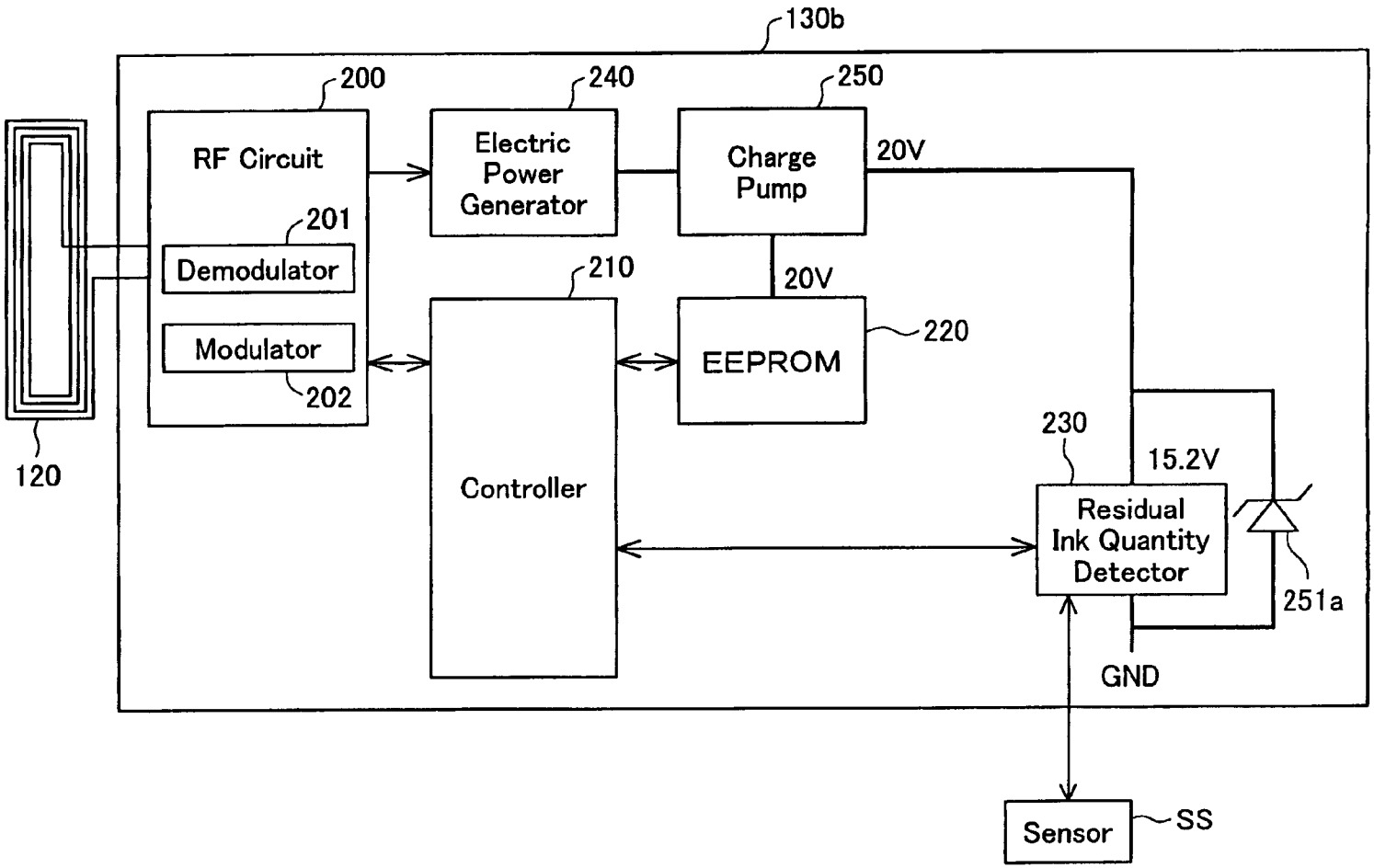
FIG. 7 is a block diagram showing the configuration of the other logic circuit including a voltage drop circuit disposed in parallel with the residual ink quantity detector in another modified example.

FIG. 7 shows the configuration of another logic circuit 130*b* which includes a voltage drop circuit 251*a* arranged in parallel with the residual ink quantity detector 230. In the logic circuit 130*b* of this modified example, the charge pump 250 directly supplies an electric power of a voltage 20 V to the EEPROM 220, while supplying an electric power of an identical voltage with an end-to-end voltage (15.2 V) of the voltage drop circuit 251*a* to the residual ink quantity detector 230.

The voltage drop circuit 251*a* has one constant voltage diode (Zener diode) and is designed by taking advantage of the constant yield voltage (Zener voltage) of the diode.

When there is a difference between a desired voltage and the yield voltage of the constant voltage diode, another diode may be joined with the constant voltage diode to generate a desired end-to-end voltage. The constant voltage diode may be applied for the voltage drop circuit, which is disposed in series between the charge pump 250 and the residual ink quantity detector 230 (see FIG. 6). The voltage drop circuit may be a constant voltage circuit including a transistor.

The scope and spirit of the present invention are indicated by the appended claims, rather than by the foregoing description.

What is claimed is:

1. A container for holding printing fluid material, the container being configured to be attached to a printing device and communicating with the printing device via a radio wave, the container comprising:

a detector configured to detect a status of the printing fluid material held in the container;

a memory unit configured to store information regarding the container;

a communication module configured to transmit at least one of a result of the detection and the information regarding the container to the printing device;

a first electric power generator configured to generate a first electric power by utilizing the radio wave received from the printing device; and a second electric power generator configured to generate a second electric power from the first electric power, the second electric power being supplied to both the detector and the memory unit.

2. The container in accordance with claim 1, wherein the second electric power generator comprises a boosting circuit configured to boost the first electric power.

3. The container in accordance with claim 2, wherein the boosting circuit is a charge pump.

4. The container in accordance with claim 1, wherein the detector comprises a sensor of a piezoelectric element.

5. The container in accordance with claim 1, wherein the memory unit is a rewritable non-volatile memory that requires a higher voltage for rewriting and erasing of stored data than a voltage required for reading the stored data.

6. The container in accordance with claim 1, further comprising:

a voltage drop module configured to drop a voltage of the electric power supplied to at least one of the detector and the memory unit.

7. The container in accordance with claim 6, wherein the voltage drop module includes at least one diode connected in series between the second electric power generator and at least one of the detector and the memory unit.

8. The container in accordance with claim 6, wherein the voltage drop module includes at least one diode connected in parallel with at least one of the detector and the memory unit.

9. A container for holding printing fluid material, the container being configured to be attached to a printing device and communicating with the printing device via a radio wave, the container comprising:

a first electric power generator configured to generate a first electric power by utilizing the radio wave received from the printing device;

a plurality of operating circuits configured to operate at a higher operating voltage than a voltage of the first electric power; and a boosting circuit configured to boost the first electric power, the boosting circuit being shared by at least part of the plurality of operating circuits.

10. The container in accordance with claim 9, wherein the at least part of the plurality of operating circuits, that share the boosting circuit, require a substantially same operating voltage.

11. The container in accordance with claim 9, wherein the at least part of the plurality of operating circuits, that share the boosting circuit, have different operating timings.

12. The container in accordance with claim 9, further comprising:

a voltage drop module configured to drop a voltage of the electric power supplied from the boosting circuit, supplied to the part of the plurality of operating circuits, the plurality of operating circuits receiving electric power supplied from the boosting circuit.

13. The container in accordance with claim 12, wherein the voltage drop module includes at least one diode connected in series between the boosting circuit and the part of the plurality of operating circuits.

14. The container in accordance with claim 12, wherein the voltage drop module includes at least one diode connected in parallel with the part of the plurality of operating circuits.

* * * * *